US005167042A

United States Patent [19]

Holmes

[11] Patent Number: 5,167,042

[45] Date of Patent: Dec. 1, 1992

[54] BATH

[76] Inventor: John W. Holmes, 45 Bodmin Road, St. Austell, Cornwall PL25 5AE, United Kingdom

[21] Appl. No.: 634,181

[22] PCT Filed: Jul. 11, 1989

[86] PCT No.: PCT/GB89/00787

§ 371 Date: Feb. 5, 1991

§ 102(e) Date: Feb. 5, 1991

[87] PCT Pub. No.: WO90/00382

PCT Pub. Date: Jan. 25, 1990

[30] Foreign Application Priority Data

Jul. 11, 1988 [GB] United Kingdom ..... 8816433

[51] Int. Cl.[5] ..... A47K 3/02

[52] U.S. Cl. ..... 4/564.1

[58] Field of Search ..... 4/495, 540, 546, 559, 4/560.1, 564.1, 565.1, 566.1, 571.1, 538

[56] References Cited

U.S. PATENT DOCUMENTS

| | | | |
|---|---|---|---|
| 2,133,587 | 10/1938 | Stark | 4/566.1 |
| 2,860,349 | 11/1958 | Blomqvist | 4/540 |
| 3,801,995 | 4/1974 | Adamson | 4/564.1 |
| 3,935,600 | 2/1976 | Scribner | 4/495 |
| 4,055,863 | 11/1977 | Duval . | |
| 4,068,326 | 1/1978 | Deschler . | |
| 4,312,084 | 1/1982 | Browning | 4/538 |
| 4,574,408 | 3/1986 | Dentler et al. | 4/560.1 |

FOREIGN PATENT DOCUMENTS

| | | |
|---|---|---|
| 14656 | 7/1910 | Denmark . |
| 1478182 | 3/1967 | France . |
| 2921/70 | 7/1970 | Norway . |
| 337086 | 5/1969 | Sweden . |
| 792406 | 3/1958 | United Kingdom . |
| 1189785 | 4/1970 | United Kingdom . |
| 1506419 | 4/1978 | United Kingdom . |
| 2014446 | 8/1979 | United Kingdom . |
| 2100596 | 1/1983 | United Kingdom . |
| 2110527 | 6/1983 | United Kingdom . |
| 2117236 | 10/1983 | United Kingdom . |
| 2131291 | 6/1984 | United Kingdom . |

*Primary Examiner*—Charles E. Phillips
*Attorney, Agent, or Firm*—Perman & Green

[57] ABSTRACT

A bath is proposed for the use of the elderly, disabled or infirm. It includes a sitting member fixedly supported so that a sitting surface thereof is at a convenient height above floor level for a user to sit on and a raisable and lowerable substantially rigid side surround shaped to extend continuously around the periphery of the sitting surface. The surround is movable between a lowered position in which it is located at least substantially below the sitting surface to allow the user to sit on or get off the sitting surface, and a raised position in which it surrounds and projects above the sitting surface to define therewith a bath cavity for receiving liquid. Sealing means are attached to the sitting member and on or attached to the surround for engaging each other to seal the surround to the sitting member in liquid tight manner in the raised position. A closeable and operable outlet is arranged to facilitate the exit of liquid from the bath cavity prior to movement of the surround to the lowered position. This bath makes it possible for disabled people to bathe themselves.

10 Claims, 8 Drawing Sheets

FIG. 13
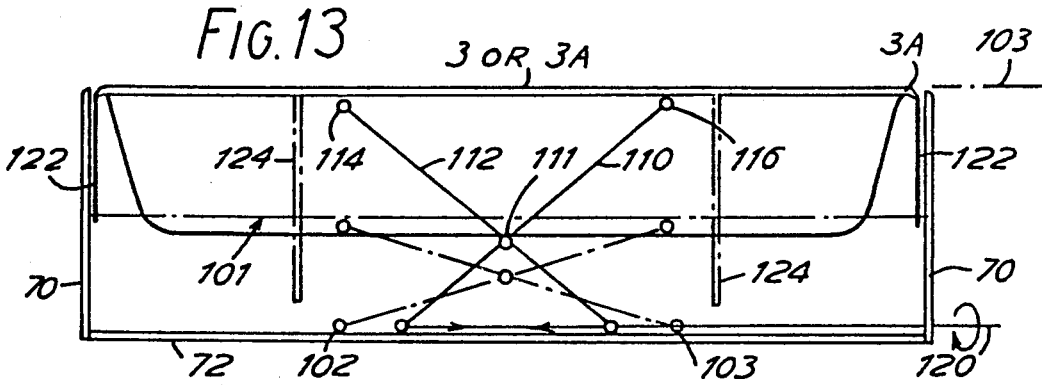
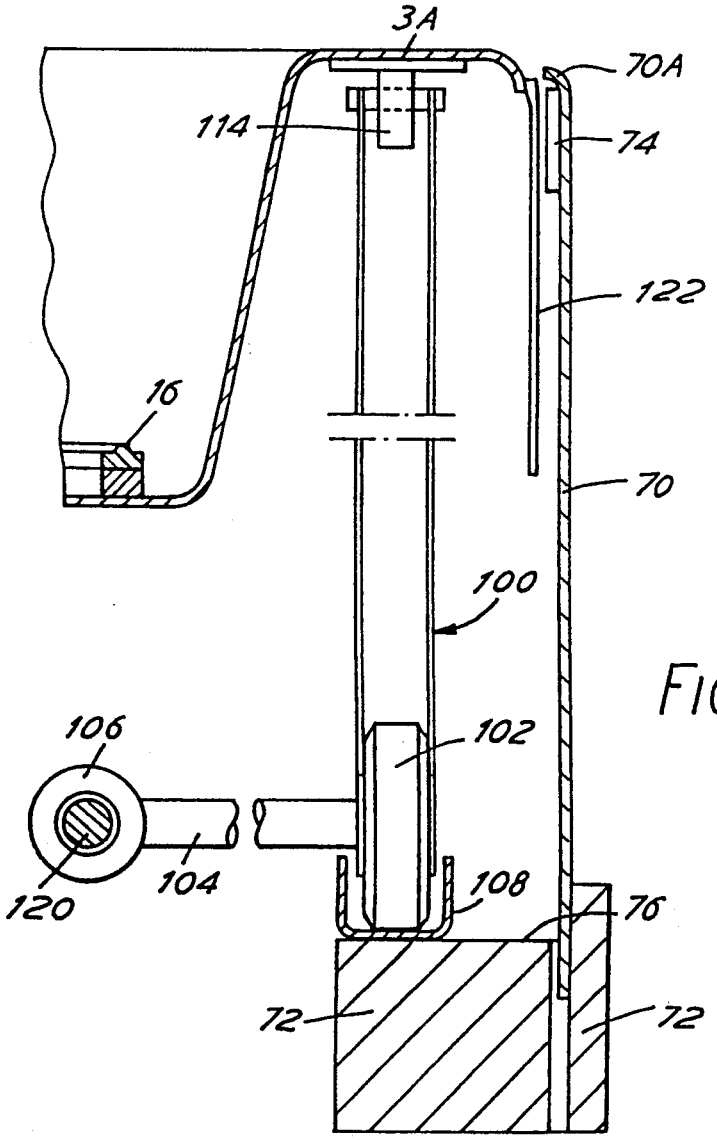
FIG. 14

BATH

This invention relates to a bath and concerns such a bath which is particularly, but not exclusively, suitable for use by or with the elderly, infirm or handicapped.

Use of a conventional bath by the elderly and those with limited use of their legs is difficult without assistance particularly in getting in and out of the bath over the raised side edge or rim and in sitting down and standing up in the bath itself. For a user of limited mobility this difficulty can lead to dangerous accidents by slipping and falling and in some cases a reluctance to use a bath at all with consequent personal hygiene problems.

Efforts have been made in the past to solve this problem by providing a collapsible or inflatable highly flexible structure which retains the bath water around the person. Usually this structure is erected once the person has stepped into, or been laid on a mattress or other support surface. For examples of earlier arrangements, the reader is referred to:

U.K. Patent (GB-A) No. 792 406 1958
U.K. Patent (GB-A) No. 1 189 785 1970
U.S. Pat. (US-A) No. 4,068,326 1978
U.K. Patent (GB-A) No. 1 506 419 1978
U.S. Pat. (US-A) No. 4,312,084 1982
U.K. Appln. (GB-A) No. 2 100 596 1983.

These arrangements are mostly intended for hospital or nursing home use and normally require at least one nurse or other competent helper to assist any elderly or infirm person who is seeking to take a bath. Also, these arrangements are reminiscent of baths used for outdoor camping, and, being non-rigid, do not resemble a normal domestic bath. Hence they may well provoke a stubborn or nervous, negative reaction in elderly or infirm persons. There remains a need for a bath usable by infirm persons, but which gives the user confidence in that it largely resembles a well known conventional bath.

A bathing apparatus for washing (and drying) persons who are bedridden or unable to bathe themselves is disclosed in U.S. Pat. No. 4,055,863 of DUVAL.

There is thus a need for a bath which is easier to use by the elderly, infirm or disabled with or without assistance.

According to the present invention there is provided a bath including sitting member fixedly supported so that a sitting surface thereof is at a convenient height above floor level for a user to sit on, a raisable and lowerable substantially rigid side surround shaped to extend continuously around the periphery of the sitting surface, which surround is movable between a lowered position in which it is located at least substantially below the sitting surface to allow the user to sit on or get off the sitting surface, and a raised position in which it surrounds and projects above the sitting surface to define therewith a bath cavity for receiving liquid therein, means attached to the sitting member and on or attached to the surround for engaging each other to seal the surround to the sitting member in liquid tight manner in the raised position, and closeable and openable outlet means arranged to facilitate the exit of liquid from the bath cavity prior to movement of the surround to the lowered position.

Preferably the sitting surface is fixedly supported on a support surface carried at the required height above floor level on a suitable support means, e.g. a legged frame, with the outlet means in the sitting surface communicating with further outlet means provided in the support surface.

Conveniently the sitting surface has a raised back support at one end thereof and preferably is made from plastics material.

Advantageously the sitting member is of elongated form.

Preferably the side surround is oval or elongate with curved ends and of such a height to extend in the lowered position from the floor level substantially to the level of the sitting member peripheral edge.

Conveniently the side surround has an out-turned lip around the upper edge thereof to form a rim for the bath and an inturned lip around the lower edge thereof. This inturned lip is for co-operation in the raised position with the sitting member.

Advantageously the means for sealing the side surround to the sitting member in liquid tight manner in the raised position includes a self centering male seal ring element and a complementary female seal ring element provided one around one of the sitting member and the side surround inturned lip and the other around the other of the sitting member and the side surround inturned lip, and a feather edge flexible lip seal between the sitting member and the inner face of the side surround.

Preferably the male seal ring element is fixedly secured around and to the upper surface of the side surround inturned lip to project upwardly therefrom and the female mating seal ring element is fixedly secured around and to the lower surface of the sitting member near the periphery thereof to depend downwardly therefrom to mate with the male seal ring element in the raised position of the side surround.

Conveniently the feather edge flexible lip seal is strip-like in shape and is fixedly secured along one edge margin thereof to the sitting member so that its free edge margin forming the feather edge extends peripherally away from said member for sliding and wiping engagement with the inner face of the side surround.

The bath includes means, which may be controlled by the bather, for raising and lowering the side surround.

The means for raising and lowering the side surround may be mechanical and/or hydraulic and/or pneumatic, or an electrical drive may be used. A scissor link arrangement is particularly advantageous.

Conveniently the side surround inturned lip is secured to a frame structure located beneath the sitting surface and the means for raising and lowering the side surround includes an elongated, externally screw threaded, member rotatably screw threadably engaged in a correspondingly internally screw threaded aperture in the frame structure and extending substantially vertically between, at its uppermost end, part of the sitting surface support surface and, at its lowermost end, a limitedly vertically movable base plate located beneath the frame structure. In this arrangement the screw threaded member is rotatable, preferably via an electric motor, in the screw threaded aperture of the frame structure to move the frame structure vertically up or down towards or away from the sitting surface and thereby to raise or lower the attached side surround.

Advantageously a base plate (which supports the raising and lowering arrangement) is movable vertically to a limited extent under the action of a cam controlled by a pivotal lever so that pivotal movement of the lever in one direction, with the side surround in the raised position, causes the cam to engage and move the base plate and attached raising and lowering arrangement vertically further to lift the side surround and fully engage the male and female seal ring elements, and lock the side surround in the raised position. The same movement advantageously (but optionally) is arranged to unlock the supply of liquid to the bath cavity.

For a better understanding of the present invention and to show how the same may be carried into effect, reference will now be made, by way of example, to the accompanying drawings, in which:

FIG. 1 is a plan view of a bath according to one embodiment of the invention seen from above, FIG. 2 is a partially sectioned side view of the bath of FIG. 1 with a side surround thereof shown in a raised position, FIG. 3 is a side view of the bath of FIGS. 1 and 2 with the side surround shown in a lowered position, FIG. 4 is an exploded perspective view of part of the bath of FIGS. 1 to 3, FIG. 5 is a transverse cross-sectional view through part of a bath of FIGS. 1 to 4 to a larger scale showing seal means in a disengaged position, FIG. 6 shows diagramatically mechanical scissor means for raising and lowering the side surround in the bath of FIGS. 1 to 5, FIG. 7 shows diagramatically an alternative hydraulic means of raising and lowering the side surround, FIG. 8 shows diagramatically a further alternative means of raising and lowering the side surround using an Archimedean screw, FIG. 9 shows diagramatically another alternative means of raising and lowering the side surround incorporating a double hydraulic action, FIG. 10 is a part sectioned, enlarged scale view from one side of detail of yet another means for raising and lowering the side surround, FIG. 11 is a composite cross-sectional view from above of the means of FIG. 10 with the top third of the Figure being taken at the line A—A in FIG. 10, with the right hand third of the Figure being taken at the line B in FIG. 10 and with the left hand third of the Figure being taken at the line C in FIG. 10.

FIGS. 13 and 14 show one form of scissor link arrangement for raising and lowering the side surround, FIG. 13 being a diagrammatic side elevation omitting the pelmet and FIG. 14 being a diagrammatic end elevation partly in cross section taken on a plane extending laterally of the bath.

A bath according to an embodiment of the invention as shown in FIGS. 1 to 11 of the accompanying drawings is intended chiefly for use with or by the elderly, infirm or handicapped. The bath includes a sitting member 1 having a sitting surface 1 fixedly supported at a convenient height above floor level for a user to sit on. In this way there is no need to step up over a conventional bath side rim and down into the bath cavity, which movement may be very difficult, if not impossible, for an elderly, infirm or handicapped user to carry out. Hence with the bath of the invention it is merely necessary for a user to sit on the surface 1A and, to swing the body sideways so that the legs slide onto the top of the sitting surface 1A, which conveniently is of elongated form as illustrated. To help in this movement any convenient grab handles may be provided such as the single grab handle 2 illustrated.

Figure 1:
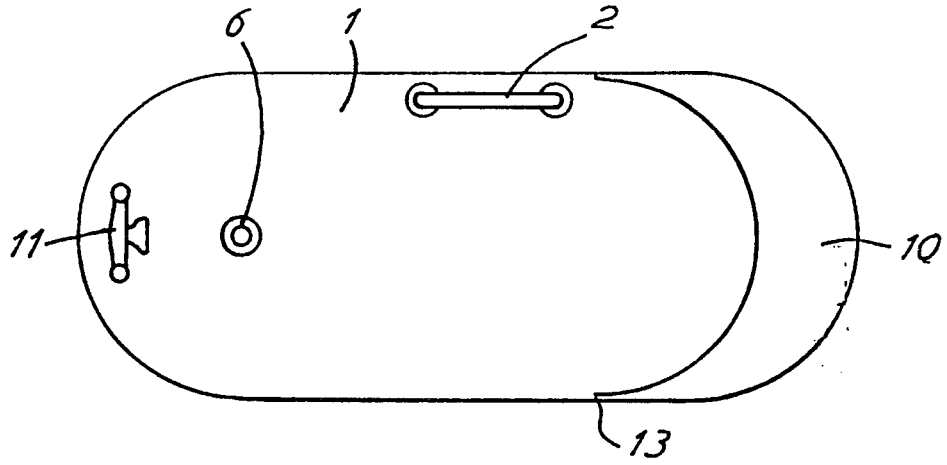
Figure 2:
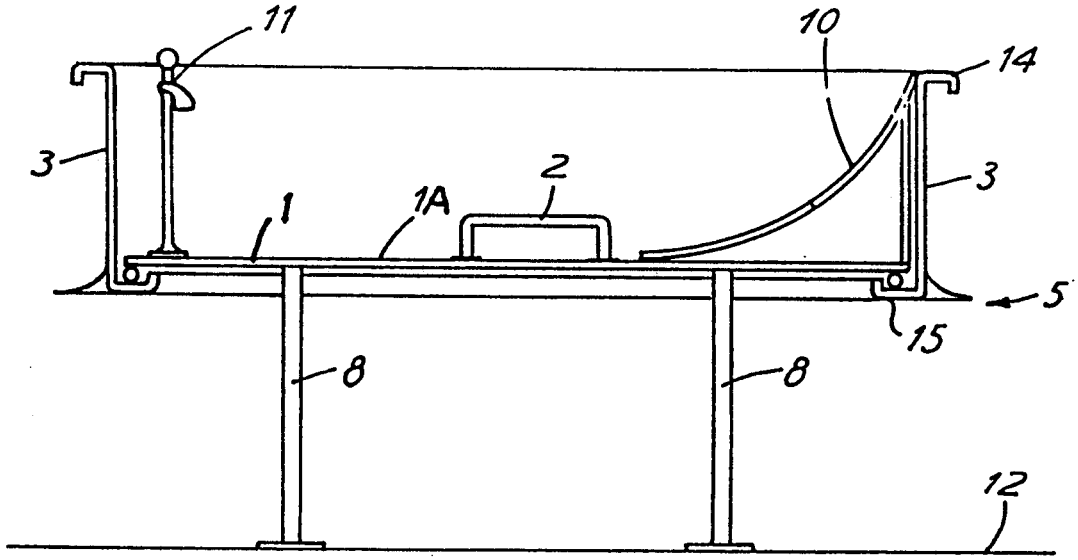
Figure 3:
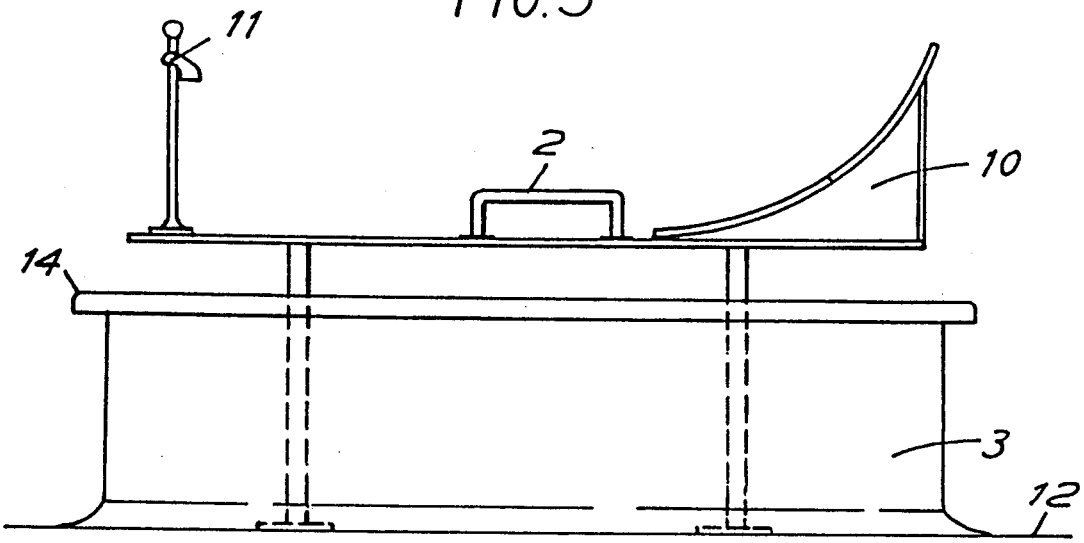
Figure 3:
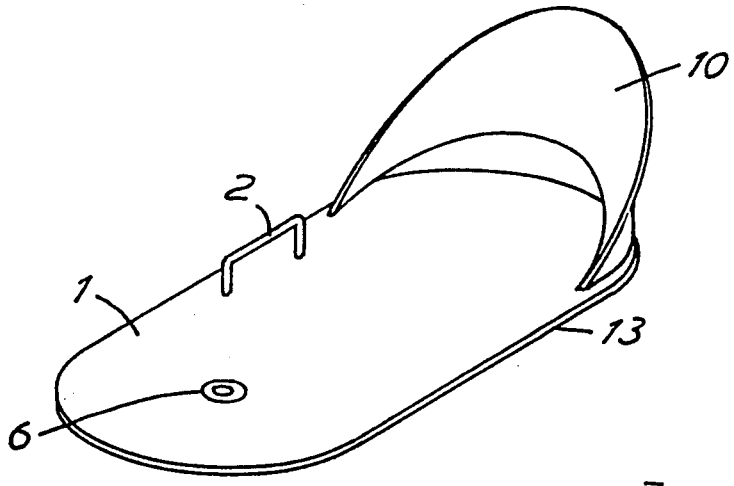
Figure 4:
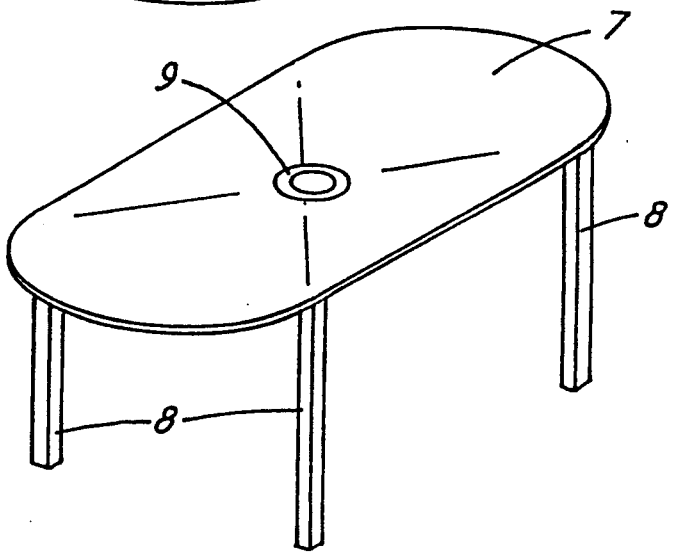

The bath of the invention also includes a raisable and lowerable substantially rigid side surround 3 shaped to extend continuously around the periphery of the sitting member 1. The sitting member 1 is preferably also substantially rigid. The side surround 3 and sitting member 1 may be made of any convenient material and are preferably made of reinforced plastics material. The surround 3 is movable between a lowered position as shown in FIG. 3 in which it is located substantially below the sitting surface A1 to allow the user to sit on or get off the sitting surface 1A and a raised position as illustrated in FIG. 2 in which it surrounds and projects above the sitting surface to define therewith a bath cavity 4 for receiving liquid, such as water. Means are provided additionally for sealing the surround 3 to the sitting member 1 in liquid tight manner in the raised position with such sealing means being indicated in more detail in FIGS. 2 and 5. Closeable and openable outlets means 6 are also provided in the sitting member 1 for the exit of liquid, such as water, from the bath cavity 4 prior to movement of the surround 3 to the lowered position.

Although the bath of the invention has been illustrated as of a conventional elongate form it could of course be of any other desired form such as circular, oval or sector shaped in plan. In the illustrated embodiment the elongated sitting member 1 is fixedly supported on a support surface 7 (FIG. 4) carried at the required height above floor level on a legged frame 8. The outlet means 6 in the member 1 communicates with further outlet means 9 provided in the support surface 7.

Preferably, as illustrated, the sitting member 1 has a raised back support 10 at one end which also is preferably made from plastics material. Inlet taps from a supply of liquid such as water, may be provided in any convenient position and of any convenient form such as illustrated at 11 in FIGS. 1 to 3.

As illustrated the side surround 3 is annular in cross-section and thus tubular in form having a height such as to extend in the lowered position from the floor level 12 substantially to the level of the sitting member peripheral edge 13. The side surround 3 has an out-turned lip 14 around the upper edge thereof to form a rim for the bath, and an inturned lip 15 around the lower edge thereof for co-operation in the raised position with the support surface 7.

The means for sealing the side surround 3 to the sitting surface 1 in liquid tight manner in the raised position includes a self centering male seal ring element 16 (FIG. 5) and a complementary female seal ring element 17 provided one around one of the sitting member 1 and side surround inturned lip 15 and the other around the other of the said member and said lip together with a feather edge flexible lip seal 18 conveniently made of rubber, between the sitting member 1 and the inner face **3*d*** of the side surround.

In the illustrated embodiment the male seal ring element 16 is fixedly secured around and to the upper surface of the side surround inturned lip to project upwardly therefrom and the seal ring element 17 is fixedly secured around and to the lower surface of the member 1 near the periphery thereof to depend downwardly therefrom to mate with the male seal ring element 16 in the raised position of the side surround 3. Conveniently the male and female seal ring elements are made of rubber with a sponge rubber backing 19.

Figure 5:
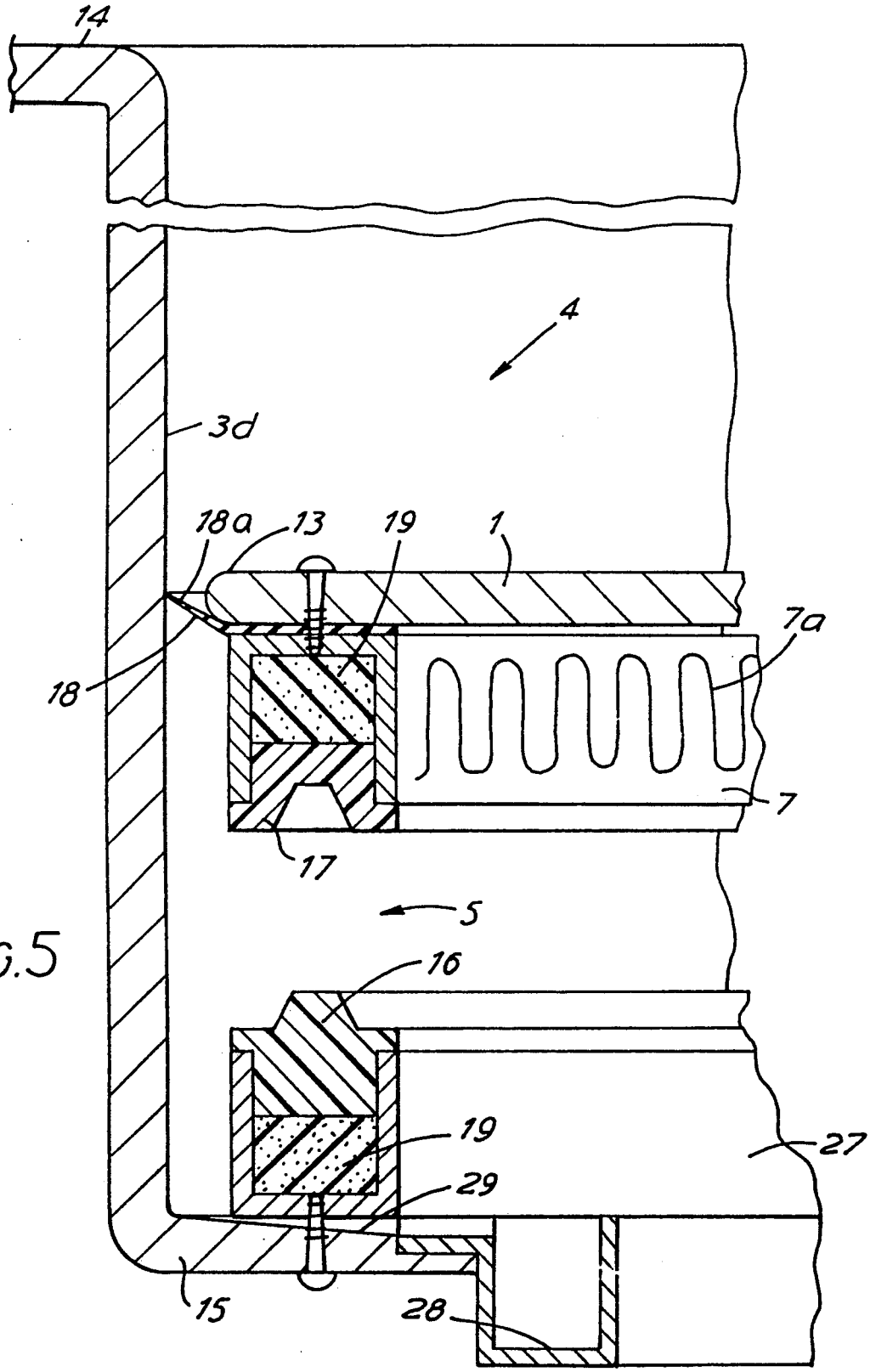

The feather edge flexible lip seal 18 is strip like in shape and is fixedly secured along one edge margin thereof to the sitting member 1 in any convenient manner and preferably to the under surface of the base surface, so that its free edge margin 18*a* forming the feather edge extends peripherally away from the member 1 for sliding engagement with the inner face 3*d* of the side surround 3 as shown in FIG. 5.

Figure 6:
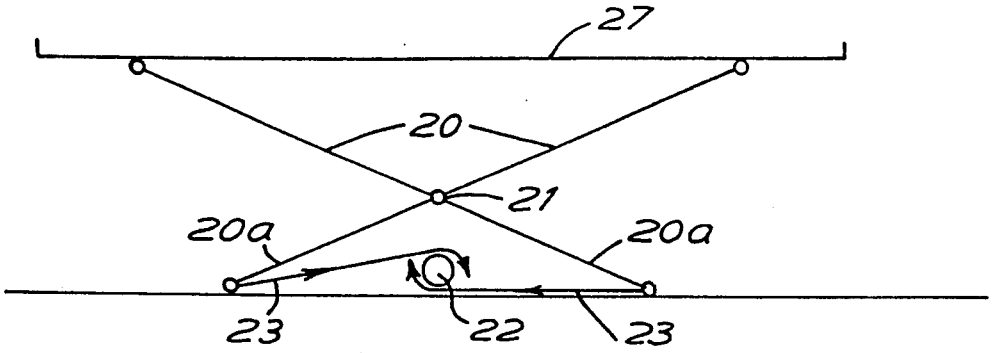

The bath of the invention includes means for raising and lowering the side surround 3. These means can take any convenient form such as mechanical and/or hydraulic. To this end FIGS. 6 to 9 show schematically alternative arrangements for raising and lowering the side surround 3 which may run fore and aft of the sitting surface 1 or transverse thereof. FIG. 6 shows a scissor arrangement having links 20 pivoting about a pivot point 21 when the ends 20*a* of the links 20 are moved towards or away from one another to raise or lower the surround 3, conveniently by means of a turn screw or winch drum 22 and cables 23 respectively linking the ends 20*a* of the links 20 to the turn screw of winch drum 22.

Figure 7:
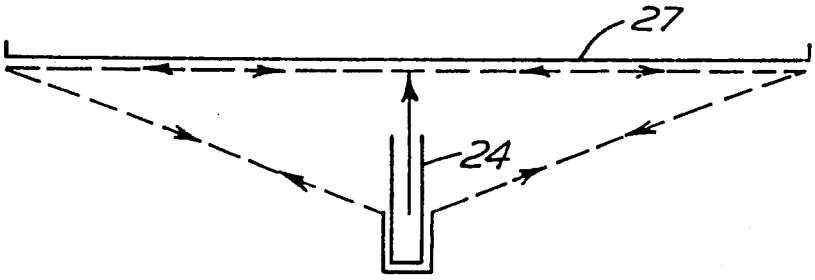
Figure 8:
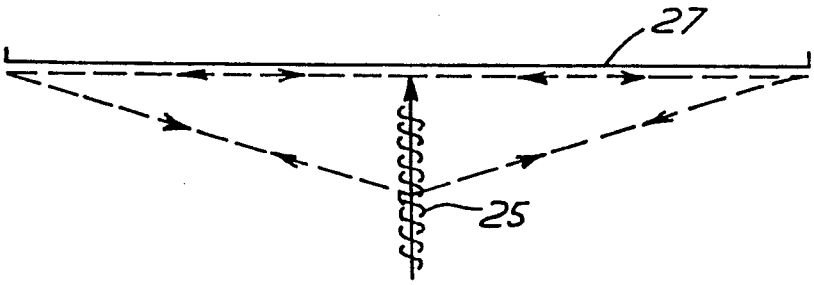
Figure 9:
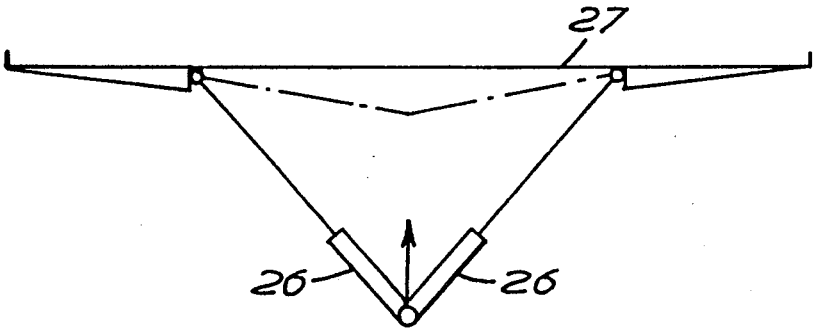

FIG. 7 shows an alternative form in which the surround 3 is raised and lowered by a hydraulic ram and cylinder assembly 24. In the arrangement of FIG. 8 an Archimedean screw 25 is utilised instead of the ram and cylinder 24 of FIG. 7 whilst in FIG. 9 a double hydraulic ram and cylinder assembly 26 is employed. In all these alternatives the means for raising and lowering the surround 3 acts either directly on the inturned lip 15 of the surround 3 or on a frame structure 27 to which the lip 15 is fixedly secured.

Figure 10:
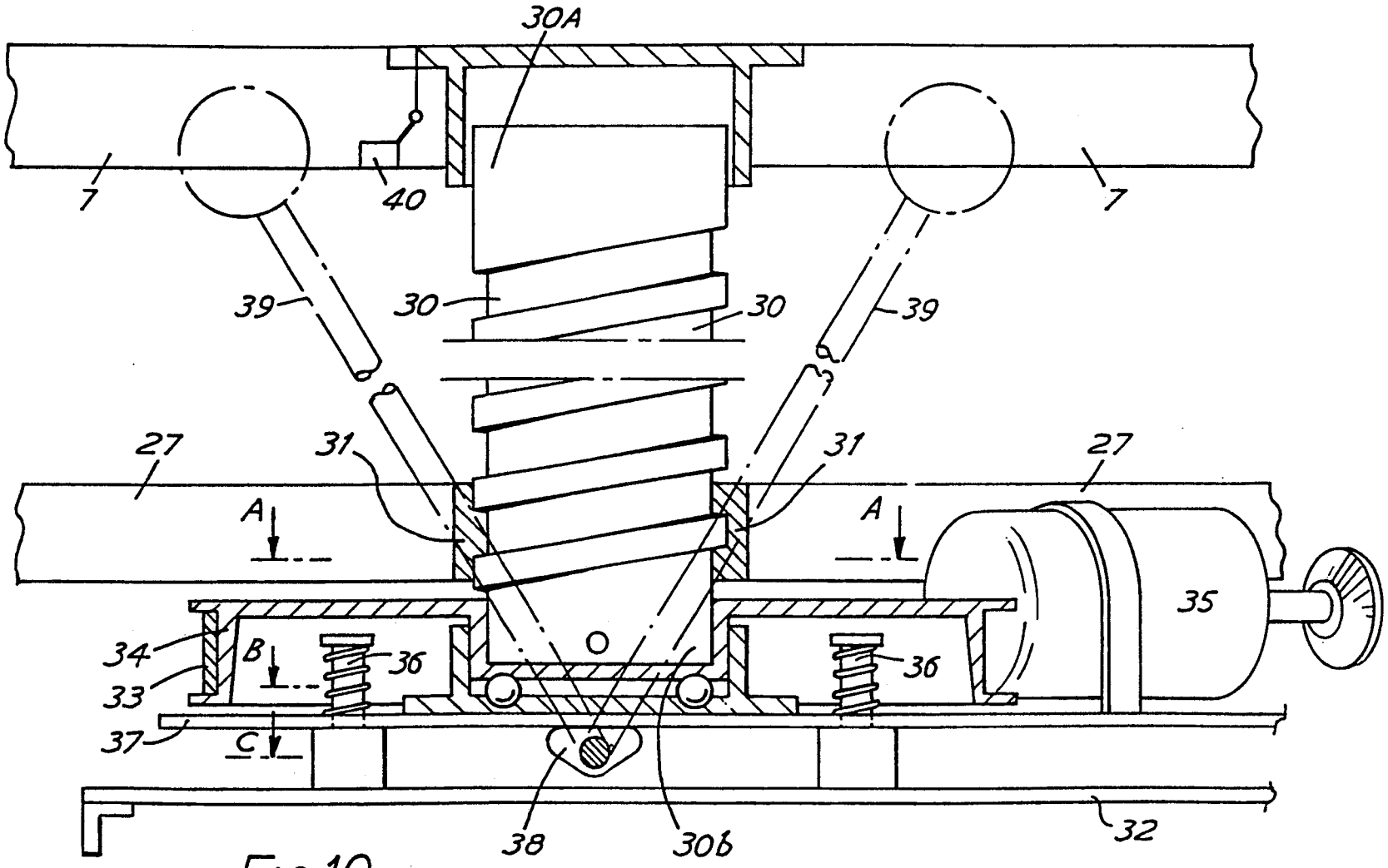
Figure 11:
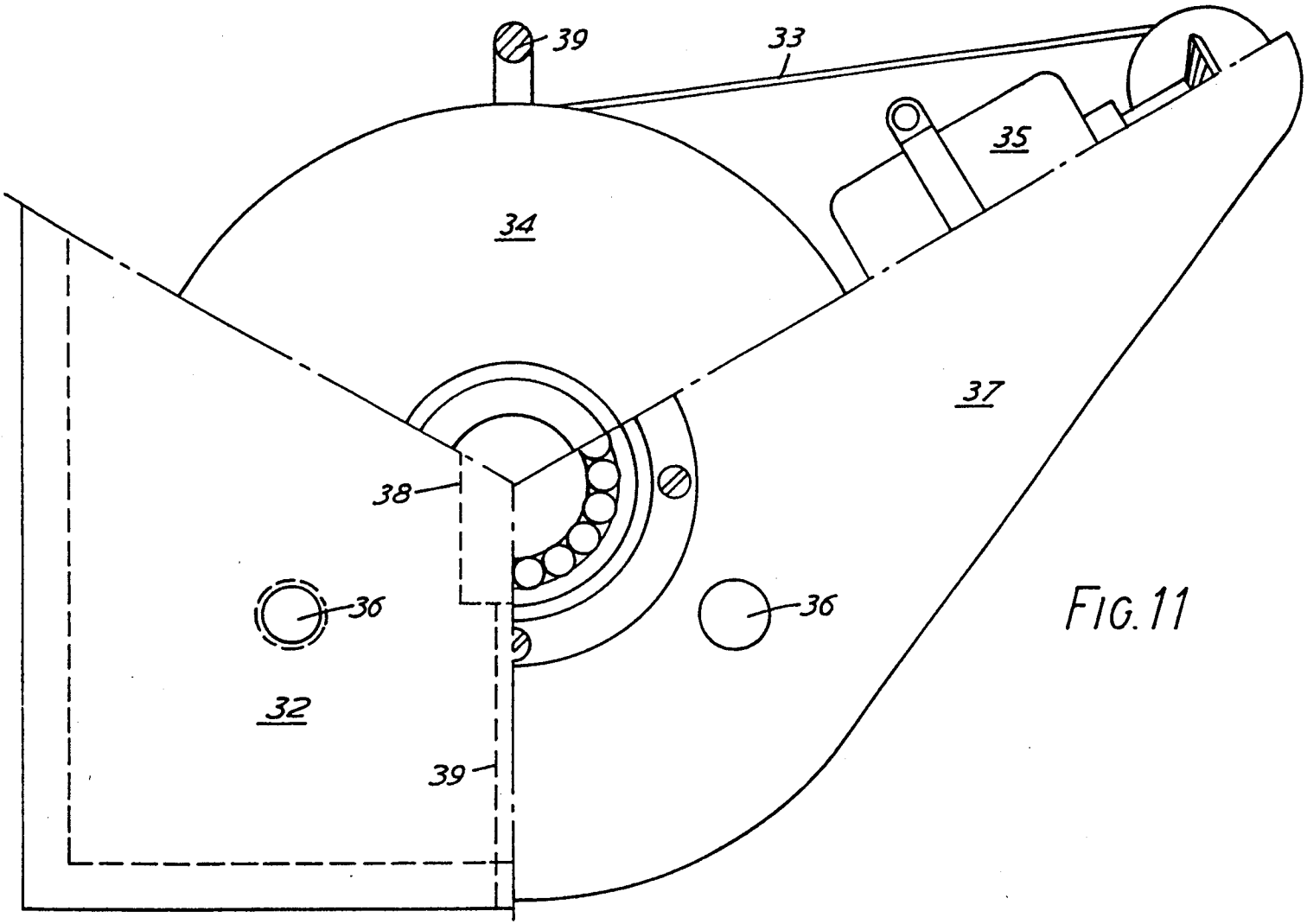

One advantageous means for raising and lowering the surround 3 is illustrated in FIGS. 5, 10 and 11 of the accompanying drawings. In this form the inturned lip 15 is secured to the frame structure 27 which is located beneath the sitting surface 1 and support surface 7 as shown in FIG. 5. The male seal ring element 16 and rubber backing 19 is thus secured both to the lip 15 of the surround 3 and the frame structure 27. The frame structure 27 is also provided with an overflow channel 28 and overflow grooves 29 are provided in the lip 15 under the seal ring element 16 to conduct into the overflow channel any liquid which should escape down between the side surround 3 and base surface 1 during use of the bath. Again as illustrated in FIG. 5 the female seal ring element 17 and rubber backing 19 are secured both to the base surface 1 and to the support surface 7 which conveniently contains insulation 7*a*.

The means for raising and lowering the surround 3 includes an elongated externally screw threaded member 30 rotatably screw threadably engaged in a correspondingly internally screw threaded aperture 31 in the frame structure 27. The screw threaded member 30 extends substantially vertically between, at its uppermost end 30*a*, part of the base surface support surface 7 and at its lowermost end 30*b*, a limitedly vertically movable base plate 32 located beneath the frame structure 27. The screw threaded member 30 is rotatable via a drive belt 33 and drum 34 attached to the lowermost end 30*b* by an electric motor 35 switched on or off in any convenient manner. The belt 33 is not shown in FIG. 10, for convenience, but is shown in FIG. 11. Rotation of the screw threaded member 30 in one direction or the other in the aperture 31 by reason of the inter-engaging screw threads drives the frame structure 27 up or down with respect to the support surface 7 and hence raises or lowers the side surround 3 attached to the frame structure 27.

The base plate 32 is movable vertically to a limited extent on spring loaded spigots 36 secured on a fixed frame part 37 as illustrated in FIG. 10. The base plate 32 is movable vertically under the action of a cam 38 controlled by a pivotal lever 39 so that pivotal movement of the lever 39 to one side with the frame structure 27 and hence the side surround 3 in the raised position as shown in FIG. 5 causes the cam 38 to engage the base plate 32 to move the latter and the attached screw threaded member 30 vertically further to lift the side surround 3 and thereby fully engage the male and female seal ring elements 16 and 17, lock the side surround 3 in the raised position and unlock a supply line of liquid to the bath cavity. In the illustrated example the cam 38 has two faces so that it can be operated to move the base plate 32 vertically upward by movement in either direction from the vertical position. Conveniently the support surface 7 includes a stop switch 40 to prevent operation of the electric motor 35 in the side surround raising direction when the frame structure 27 is fully raised.

Thus to use the bath of the invention the user merely ensures that the surround 3 is in the lowered position, sits on the base surface 1, reclines against the back support 10, holds the grab handle 2 and swings the legs onto the base surface 1. The side surround 3 is then elevated by means of the electric motor drive and locked in position by means of the lever 39 which turns on the water supply to the taps 11. The outlet means 6 is then closed and water discharged into the bath from the taps 11. The foregoing operation is carried out in reverse when the user wishes to leave the bath, with the first action being to open the outlet means 6 to allow the bath water to run out of the bath cavity, followed by lowering of the side surround 3, so that the user can pivot on the sitting surface and swing his/her legs down until his/her feet reach the floor. Although not illustrated or described the bath may also incorporate hydro-therapy facilities if desired.

Figure 12:
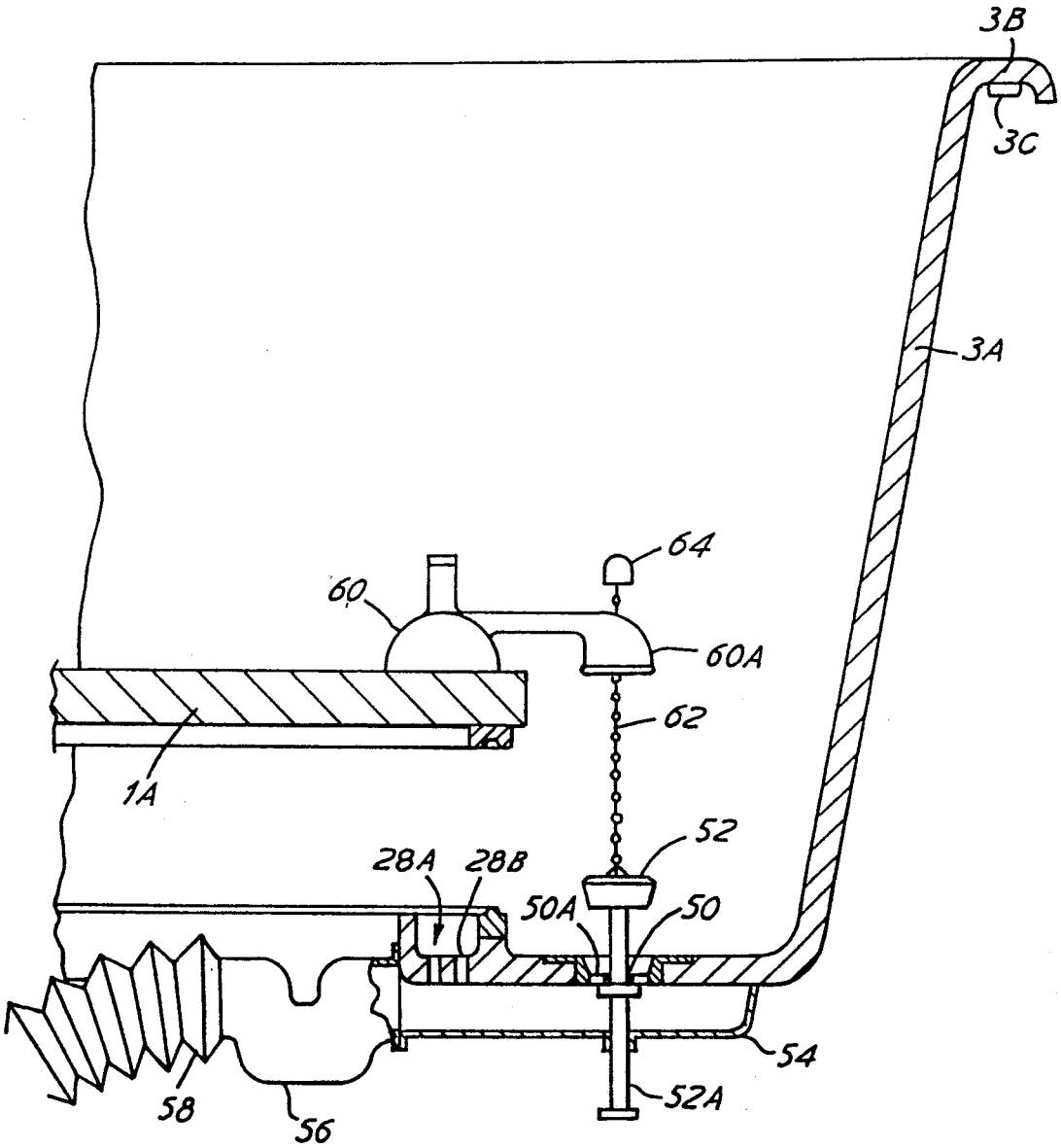
FIG. 12 illustrates, in diagrammatic vertical cross section, one form of waste outlet and leakage removal channel, the cross section being taken laterally of the bath but showing one side only.

FIG. 12 illustrates, in diagrammatic cross-section one form of waste outlet and leakage removal channel. The side surround 3A is provided with a relief channel 28A which extends completely around the surround 3A. The means for achieving vertical reciprocation of the side surround 3A relative to the fixed sitting surface 1A is not shown in FIG. 12. The side surround 3A has an outwardly curved over lip 3B, and a hole 50 closable by a plug 52. The plug shaft 52A is supported by a spider 50A. The hole leads to a conduit chamber 54 on the underside of the surround 3A which (at one or more peripheral locations) is connected to a conventional trap 56. From this, waste bath water passes into a flexible waste pipe 58. At the base of the relief channel 28A there is provided one or more holes 28B which allow water collecting in the relief channel 28A to pass into the conduit chamber 54. Fitted on the sitting surface 1A is a water supply tap 60 (which may be a mixer type tap). The hot and cold water supplies to this are not shown. The tap 60 is located directly above the plug 52. As an optional feature, the plug may be raised and lowered using a chain 62 which passes through a suitable hole in the tap outlet pipe 60A and has on its free end a handle 64. Of course the conduit chamber 54 is sealed around the place where the plug stem 52A passes through its wall. The length of the chain is chosen in accordance with the extent of vertical movement of the surround 3A.

The curved over portion 3B of the side surround 3A has a stiffener 3C on its underside. This extends along the stright portion only of each side of the surround 3A, and provides a contact surface to which is fixed a block forming part of the lifting mechanism which raises and lowers the side surround.

An arrangement for water overflow may be provided by connecting a conduit which extends up the outer surface of the side surround 3A to the conduit chamber 54 at one peripheral location. This conduit terminates at its upper end in a hole through the side surround 3A. With this arrangement, the hole represents an overflow outlet and if the bath is overfilled, water will exit through the hole and run away to the waste pipe 58 via the chamber 54.

An advantageous form of lifting and lowering mechanism 100 for the side surround 3 or 3A is the scissor link arrangement generally illustrated in FIG. 6. One form of scissor link arrangement will now be described in more detail referring to FIGS. 13 and 14, the former being a diagrammatic side elevation and the latter an end elevation partly in cross-section taken on a plane extending laterally of the bath. Referring firstly to FIG. 14, the lifting mechanism includes a scissor link assembly at each side of the bath. A side panel 70 of the bath is carried by lower panel frame member 72 and upper panel frame member 74, the former extending along the bath side and having most of its upper surface as a flat surface 76 along which runs one roller 102 of the mechanism 100. The rollers thereof, including the roller 102, may be made of a polyamide plastics material such as "NYLON". The panel 70 may be curved over at the top as seen at 70A to give an aesthetic appearance. The side surround 3 has a curved over lip 3A and carries a seal means 16. The seal means has already been described with reference to FIG. 5. The roller 102 runs freely on a non-rotating axle 104 which extends laterally of the bath and also carries another free running roller (not shown) which runs on the lower frame member at the opposite side of the bath. As illustrated in FIG. 14, a channel shaped track 108 receives and guides the roller 102 (and a like track may be provided on the other side) but in some circumstances it may be possible to dispense with such a track. The axle 104 at its mid point is connected to a threaded boss 106.

The lifting and lowering mechanism 100 comprises a pair of scissor links each arranged substantially in a vertical plane, one at each side of the bath. One scissor link is shown in FIG. 13 and comprises a first link 110 pivoted (111) at an intermediate region to a second link 112. Each of these links has a roller (102 or 103) at its lower end. The two scissor links are cross-connected by non-rotating axles, one being shown at 104 which connects roller 102 with its counterpart on the other side. The upper ends of the links 110, 112 are pivotally attached to blocks 114, 116 which are fixed to the underside of the turned over edge 3A.

The roller 103 is connected to its counterpart roller at the other side in a similar way by a cross axle, and the connecting non-rotating axle also has a boss mounted at its mid-point. Each of the bosses has a central threaded hole therein to receive a rod 120 half of which is right-hand threaded and the other half of which is left-hand threaded. The rod 120 extends longitudinally and centrally of the bath near to floor level. The rod 120 is rotated by any suitable drive means, e.g. an electric motor. When rotated in one rotating direction the bosses are moved apart from one another so lowering the side surround 3 or 3A to a position indicated at 101 in FIG. 13 and when rotated in the opposite rotary direction the bosses are moved towards each other so raising the top of side surround to the height indicated at 103 in FIG. 3. A pelmet 122, supported by thin bracing members 124, is attached to and extends downwardly from the outer margin of the curved over lip 3A. This hides and protects the working parts of the scissor link arrangement. This arrangement for lifting the side surround ensures a smooth vertical lift, and is trouble free due to its simplicity, and requires very little maintenance. As the electric motor is remote from any area which could be reached by escaping water, the arrangement has the advantage of being substantially safe.

In an advantageous version of the FIGS. 13 and 14 embodiment, not illustrated, a short portion at each end of each track 108 is sloped upwardly. When, during raising of the side surround, the relevant roller rolls up this sloped portion, the engagement between the seals 16 and 17 is made firmer, so further reducing the possibility of leakage.

I claim:

1. A bath including a sitting member having a sitting surface, said member being fixedly supported so that said sitting surface is at a convenient height above a floor level for a user to sit thereon, a raisable and lowerable substantially rigid side surround shaped to extend continuously around a periphery of the sitting surface, which surround is movable between a lowered position in which it is located at least substantially below the sitting surface to allow the user access to the sitting surface without interference by said surround, and a raised position in which it surrounds at least a portion of said sitting surface and projects above the sitting surface such that said surround and said surface define a bath cavity for receiving and holding liquid therein, means attached to the surround for engaging each other to seal the surround to the sitting member in liquid tight manner in the raised position, and closeable and openable outlet means arranged to facilitate the exit of liquid from the bath cavity prior to movement of the surround to the lowered position.

2. A bath according to claim 1 in which the sitting member is fixedly supported on a support surface carried at the required height above floor level on a legged frame, with the outlet means in the sitting member communicating with further outlet means provided in the support surface.

3. A bath according to claim 1 in which the side surround has an out-turned lip around the upper edge thereof to form a rim for the bath and an inturned lip around the lower edge thereof for co-operation in the raised position with the sitting member.

4. A bath according to claim 1 in which the means for sealing the side surround to the sitting member in liquid tight manner in the raised position includes a self centering male seal ring element and a complementary female seal ring element provided one around one of the sitting member and side surround inturned lip and the other around the other of the sitting member and the side surround inturned lip, and a feather edge flexible lip seal between the sitting member and the inner face of the side surround.

5. A bath according to claim 4 in which the male seal ring element is fixedly secured around and to the upper surface of the side surround inturned lip to project upwardly therefrom and the female mating seal ring element is fixedly secured around and to the lower surface of the sitting member near the periphery thereof to depend downwardly therefrom to mate and seal with the male seal ring element in the raised position of the side surround.

6. A bath according to claim 4 in which the feather edge flexible lip seal is strip-like in shape and is fixedly secured along one edge margin thereof to the sitting member so that its free edge margin forming the feather edge extends peripherally away from the sitting member for sliding engagement with the inner face of the side surround.

7. A bath according to any of claim 1 which includes a means for raising and lowering the side surround.

8. A bath according to claim 7 in which the means for raising is mounted on a base plate, and the base plate is movable vertically to a limited extent under the action of a cam controlled by a pivotal lever so that a pivotal movement of the lever in one direction, with the support surface and hence the side surround in the raised position, causes the cam to engage and move the base plate and attached raising/lowering arrangement vertically further to lift the side surround and fully engage the male and female seal ring elements, lock the side surround in the raised position and unlock the supply of liquid to the bath cavity.

9. A bath according to claim 7 in which the said means is an arrangement having an electric-motor-driven leadscrew arrangement.

10. A bath according to claim 7 in which the side surround is raised and lowered by a scissor link arrangement comprising a scissor link assembly at each side of the bath, each assembly comprising two pivotally connected links and the lower end of each link carrying a freely-rotatable roller which runs along a track.

* * * * *